United States Patent [19]

Lorimor

[11] 4,086,843

[45] May 2, 1978

[54] TILT TIP CIRCUIT WITH BYPASS VALVE

[75] Inventor: Larry W. Lorimor, Joliet, Ill.

[73] Assignee: Caterpillar Tractor Co., Peoria, Ill.

[21] Appl. No.: 769,626

[22] Filed: Feb. 17, 1977

[51] Int. Cl.[2] ..... F15B 11/00

[52] U.S. Cl. ..... 91/413; 91/461; 60/468; 60/484; 172/803

[58] Field of Search ..... 172/803, 804, 805, 807; 91/413, 461; 60/468, 484

[56] References Cited

U.S. PATENT DOCUMENTS

| | | | |
|---|---|---|---|
| 3,184,920 | 5/1956 | Lohbauer | 91/414 X |
| 3,705,631 | 12/1972 | Seaberg | 91/413 X |
| 3,774,696 | 11/1973 | Horsch | 60/484 X |
| 3,997,007 | 12/1976 | Junck et al. | 172/804 |

*Primary Examiner*—Edgar W. Geoghegan

*Attorney, Agent, or Firm*—Phillips, Moore, Weissenberger, Lempio & Majestic

[57] ABSTRACT

In a fluid system having a main control valve and bypass control valve both responsive to pilot pressure for actuation thereof for supplying fluid to a pair of hydraulic actuators and a pair of bypass valves, the pump's flow is supplied to the first actuator and the exhaust therefrom to the second via a third control valve, the exhaust from the second actuator returns via the third control valve and the main control valve to sump, the pump's flow being subjected through the bypass control valve to the first of the bypass valves whereby once a first predetermined pressure has been reached, the pump's flow passes via the bypass valve through the second end of the first actuator and is combined with the exhaust of the first actuator for driving the second actuator.

6 Claims, 3 Drawing Figures

TILT TIP CIRCUIT WITH BYPASS VALVE

BACKGROUND OF THE INVENTION

1. Field of the Invention

The invention is concerned with a fluid flow control system for an earth moving blade such as a bulldozer blade.

2. Prior Art

Bulldozer blades and the like as is well known, must be provided with means for causing them to tip forwardly or rearwardly and to tilt leftwardly or rightwardly if said blades are to have full and desirable adjustability for use in different terrain. U.S. Pat. No. 3,705,631 teaches the use of a blade having a center pivot point controlled by two different hydraulic cylinders for allowing the blade to be tilted right or left or tipped forward or backward. U.S. Pat. No. 3,744,696 teaches the use of a control valve and a selector valve for allowing a dozer blade to either be tipped or tilted responsive to valve actuation. U.S. Pat. No. 3,184,920, commonly assigned herewith, teaches the use of two tip cylinders and a third cylinder for causing tilt of a dozer blade.

The present invention provides a unique hydraulic implement circuit wherein twin cylinders, and associated componentry, selectively operated provide blade tilt and tip. Additionally, such circuit is particularly adapted for use with a pair of levers to control the circuit whereby the use of complicated electronic switching arrangements is eliminated.

SUMMARY OF THE INVENTION

The invention is concerned with an improvement in a fluid control system for an earth moving blade pivotally supported on a vehicle for selectively varying the tip and tilt of the blade relative to a ground surface through selectable extension and contraction of a first and a second hydraulic motor which communicate between the vehicle and the blade responsive to directing of flow from main pump means via main control valve means receiving a main fluid inflow from the main pump means and being in flow communication via a first flow path with a head end of the first hydraulic motor and in flow communication via a second flow path with the second hydraulic motor and delivering an outflow from the second hydraulic motor to sump means. The improvement comprises a first biased closed bypass valve provided in a third flow path which communicates the main control valve means with a rod end of the first hydraulic motor. A second biased closed bypass valve is provided in a fourth flow path which communicates the main control valve means with a rod end of the second hydraulic motor. Bypass control valve means receives the main inflow and delivers the main inflow selectively to a bias opposing portion of a respective one of said first and second bypass valves to produce a sufficient force to overcome the biasing thereof and thereby cause said respective one of said first and second bypass valves to open responsive to pressure in a respective one of said first and second flow paths while connecting with a bias opposing portion of a respective other of the first and second bypass valves and communicating said respective other bias opposing portion to said sump means. Pilot control valve means receive a pilot inflow and selectively deliver the pilot inflow to substantially simultaneously shift the main control valve means and the bypass control valve means into a first pilot mode in which the bypass control valve means delivers the main inflow to the bias opposing portion of the first bypass valve while the main control valve means delivers the main inflow to the head end of the first hydraulic motor and into a second pilot mode in which the bypass control valve means delivers the main inflow to the bias opposing portion of the second bypass valve while the main control valve means delivers the main inflow to the second hydraulic motor. Operator shiftable control means are provided for selectively shifting the pilot control valve means to the first and second pilot modes.

BRIEF DESCRIPTION OF THE DRAWINGS

The invention and various advantageous objectives attained thereby will be made apparent by reference to the accompanying drawings in the figures of which like numbers denote like parts throughout and wherein.

DETAILED DESCRIPTION OF THE PREFERRED EMBODIMENT

Figure 1:
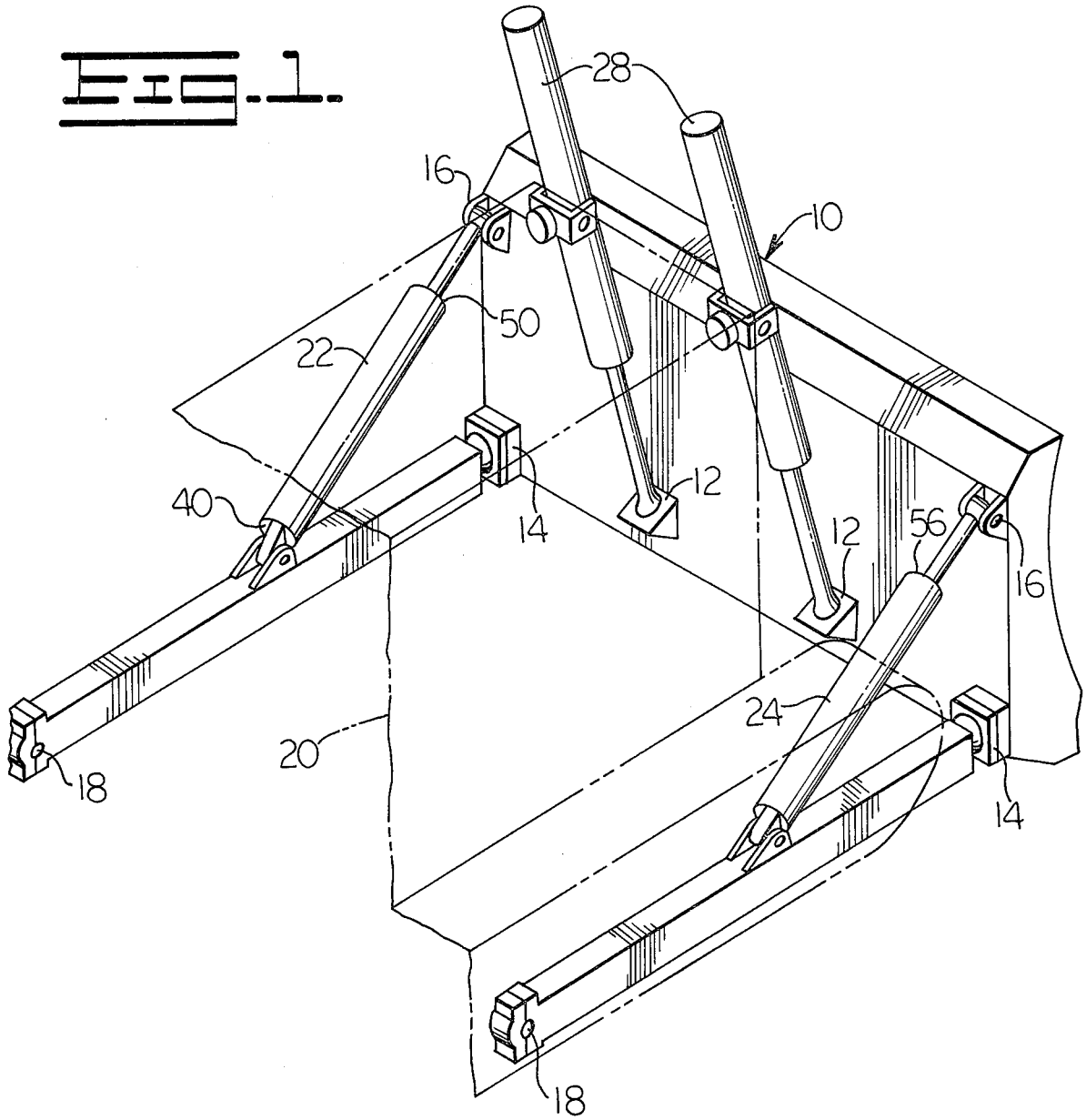
FIG. 1 illustrates an earth moving blade and its attachment on a vehicle.

Adverting to FIG. 1 there is illustrated an earth moving blade 10 pivotally supported as at 12, 14, 16 and 18 on a vehicle shown in phantom and indicated generally by the numeral 20 whereby the tip and tilt positions of the blade 10 can be selectively varied relative to a ground surface through selectable extension and contraction of a first hydraulic motor 22 and a second hydraulic motor 24. Tipping backward can be accomplished by simultaneously shortening the first hydraulic motor 22 and the second hydraulic motor 24. Tipping forward can be accomplished by simultaneous extension of the first hydraulic motor 22 and the second hydraulic motor 24. Tilting can be accomplished by extending one of the first and second hydraulic motors 22 and 24 while retracting the other thereof. The present invention is concerned with the control system 26 illustrated primarily in FIG. 2 of the drawings, which control system 26 accomplishes more responsive movement of the first hydraulic motor 22 and the second hydraulic motor 24 and hence more responsive movement of the blade 10 to operator shifting of appropriate control means.

Figures 2, 3:
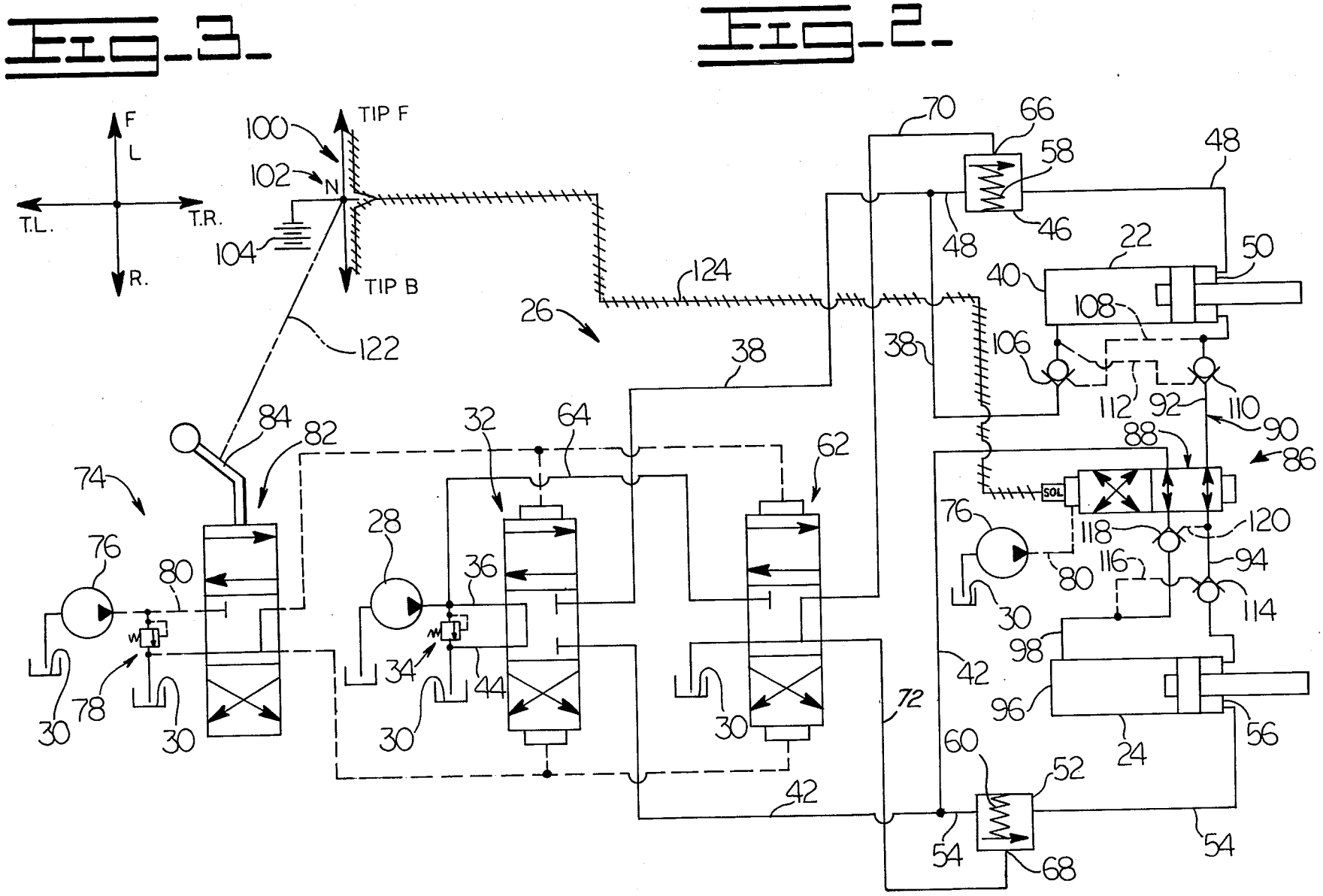
FIG. 2 illustrates schematically the improved control system of the present invention and its interaction with hydraulic motors shown in FIG. 1.
FIG. 3 illustrates schematically the modes of operation attainable using the unique fluid flow control system of the present invention.

Adverting now to FIG. 2, there is illustrated therein a main pump 28 pumping fluid from a sump 30 to a main control valve 32. A pressure relief valve 34 of conventional design is provided for the main pump 28. The main control valve 32 receives a main inflow from the main pump 28 passing via a conduit 36. The main control valve 32 is in flow communication via a first flow path 38 with a head end 40 of the first hydraulic motor 22. The main control valve 32 is also in flow communication via a second flow path 42 with the second hydraulic motor 24. Further, the main control valve 32 is in flow communication to deliver an outflow from the second hydraulic motor 24 to the sump 30 as via a conduit 44. It is of course to be understood that depending on the shifting of the main control valve 32, either of the hydraulic motors 22 and 24 can be considered as "first" or "second".

A first bypass valve 46 is provided in a third flow path 48 which communicates the main control valve 32 with a rod end 50 of the first hydraulic motor 22. A second bypass valve 52 is in a fourth flow path 54 which communicates the main control valve 32 with a rod end 56 of the second hydraulic motor 24. The first bypass valve 46 is biased into a closed position by biasing means such as a first bypass valve spring 58. The second bypass valve 52 is likewise biased closed by a second bypass valve spring 60. The bypass valves 46 and 52 serve to direct flow through the respective rod ends 50 and 56 after the respective rods have been fully extended.

A bypass control valve 62 receives a main inflow of pressurized fluid from the main pump 28 via a conduit 64. The inflow from the main pump 28 is delivered by the bypass control valve 62 selectively to a bias opposing portion 66 of the first bias valve 46 or to a bias opposing portion 68 of the second bypass valve 52 to cause the first bypass valve 46 or the second bypass valve 52 to open. At the same time, the bypass control valve 62 serves to connect the bias opposing portion 66 or 68 as the case may be of a respective other of the first bypass valve 46 and the second bypass valve 52 through said bypass control valve 62 and into the sump 30. If, for example, the bypass valve 62 is shifted downwardly from the position illustrated in FIG. 2, then the bias opposing portion 66 of the first bypass valve 46 is pressurized via a conduit 70 and the first bypass valve 46 will shift as soon as sufficient pressure has built up due to the rod of the first motor 22 having extended fully, thus overcoming the strength of the first bypass valve spring 58, which may be set for example at 2,500 psi, and at the same time, the bias opposing portion 68 of the second bypass valve 52 is communicated with the sump 30 via a conduit 72 and the bypass control valve 62.

The main control valve 32 and the bypass control valve 62 are operated simultaneously by a pilot system indicated generally at 74. The pilot system 74 includes a pilot pump 76 with a conventional pressure relief valve 78 leading to the sump 30 to assure that overpressure will not be developed in a conduit 80 which leads from the pilot pump 76 to a pilot control valve 82. The pilot control valve 82 receives a pilot inflow produced by the pilot pump 76 and selectively delivers the pilot inflow to substantially simultaneously shift both the main control valve 32 and the bypass control valve 62. The shifting provides a first pilot mode in which the bypass control valve 62 delivers the main inflow from the main pump 28 to the bias opposing portion 66 of the first bypass valve 46 while the main control valve 32 at the same time delivers the inflow from the main pump 28 to the head end 40 of the first hydraulic motor 22. The pilot control valve also provides a second pilot mode in which the bypass control valve 62 delivers the inflow from the main pump 28 via the conduit 72 to the bias opposing portion 68 of the second bypass valve 52 while simultaneously the main control valve 32 delivers the inflow from the main pump 28 to the second hydraulic motor 24 via the second flow path 42. Operator shiftable control means, in the embodiment illustrated as pilot lever 84, serves to selectively shift the pilot control valve means between the aforementioned first and second pilot modes. For example, the pilot lever 84 can be shifted whereby the pilot control valve 82 will move downwardly from the position shown in FIG. 2 thus pressurizing the top portions of both the main control valve 32 and the bypass control valve 62 and forcing these two valves downwardly to attain the abovementioned first pilot mode of operation. The pilot lever 84 can be shifted to another position whereby the pilot control valve 82 will be moved upwardly from the position shown in FIG. 2 and this will cause pressure to be applied to the bottoms of the main control valve 32 and the bypass control valve 62 shifting these two valves upwardly whereby the aforementioned second pilot mode will be attained.

A motor control valve system 86 serves to control and thus to select either tip or tilt operation through controlling whether the first hydraulic motor 22 and the second hydraulic motor 24 each extend or contract at the same time wherein tip opertion is provided or alternatively for selecting a mode of operation whereby when the first hydraulic motor 22 contracts, the second hydraulic motor 24 expands and vice versa whereby tilt operation is selected. To accomplish this, a motor control valve 88 is provided in a hydraulic motor flow path 90, which flow path 90 serves to communicate the rod end 50 of the first hydraulic motor 22 with the second hydraulic motor 24. The motor control valve 88 provides a first motor mode wherein there is fluid flow connection via a first branch path 92 which proceeds from the rod end 50 of the first hydraulic motor 22 and via a second branch path 94 to the rod end 56 of the second hydraulic motor 24. At the same time, fluid flow connection is provided by the motor control valve 88 between a head end 96 of the second hydraulic motor 24 via a third branch path 98, the motor control valve 88, the second flow path 42 and the main control valve 32 to the sump 30. The motor control valve 88 further provides a second motor mode wherein there is fluid flow connection between the rod end 50 of the first hydraulic motor 22 via the first branch path 92 and the third branch path 98 to the head end 96 of the second hydraulic motor 24 while simultaneously fluid connection is provided from the rod end 56 of the second hydraulic motor 24 via the second branch path 94, the motor control valve 88, the second flow path 42 and the main control valve 32 to the sump 30. It is clear that this occurs when the motor control valve 88 is shifted rightwardly from the position shown in FIG. 2.

An operator shiftable motor control lever represented schematically at 100 serves for selectively shifting the motor control valve 88 between the aforementioned first and second motor modes. It has been found advantageous in order to simplify control valve actuation means to make the motor control valve 88 comprise a solenoid control valve which controls application of pressure from the pilot pump 76 to shift the motor control valve 88 between the aforementioned first motor mode and second motor mode. The operator shiftable motor control lever 100 then serves to make or break a solenoid actuator circuit 102 having a power source such as a battery 104 therein. The control lever 100 also shifts the control valve 82 simultaneously with energizing of the solenoid of the motor control valve 88. When the motor control lever 100 is in the central position as illustrated in FIG. 3, the apparatus is in the tilt mode of operation and movement of the pilot lever 84 determines whether or not the tilting is rightwardly or leftwardly. When the motor control lever 100 is moved upwardly, this moves the motor control valve 88 and pilot control valve 82 in a direction which will cause the blade 10 to tip forward. When the motor control lever 100 is moved downwardly the control valves 82 and 88 are positioned to produce rearward blade tip.

Use of certain pilot operated check valves in the first flow path 38, the first branch path 92, the second branch path 94 and the third branch path 98 has been found to be particularly advantageous in preventing cavitation within the hydraulic system and/or an overruning condition of the motors 22, 24. In particular it is advantageous to provide within the first flow path 38 a first pressure actuated check valve 106 which always allows flow through the first flow path 38 towards the head end 40 of the first hydraulic motor 22 and which allows flow through the first flow path 38 away from the head end 40 of the first hydraulic motor 22 responsive to pressure in the rod end 50 of the first hydraulic motor 22 exceeding a first pilot value with the pressure in the rod end 50 of the first hydraulic motor 22 being communicated as via a first pilot line 108 to actuate the first pressure actuated check valve 106. Thus, when the rod end 50 of the first hydraulic motor 22 is being pressurized whereby the first hydraulic motor 22 is being contracted, flow can proceed out of the head end of the first hydraulic motor 22 and past the check valve 106, then through the first flow path 38 and the main control valve 32 to the sump 30. This would occur when the main control valve 32 was shifted upwardly from the position illustrated in FIG. 2. The first branch path 92 includes a second pressure actuated check valve 110 which always allows flow through the first branch path 92 towards the rod end 50 of the first hydraulic motor 22 and which allows flow through the first branch path 92 away from the rod end 50 of the first hydraulic motor 22 responsive to pressure in the head end 40 of the first hydraulic motor 22 exceeding a second pilot value. The pressure in the head end 40 of the first hydraulic motor 22 is sensed by the second pressure actuated check valve 110 via a second pilot line 112.

The second branch path 94 includes a third pressure actuated check valve 114 which always allows flow through the second branch path 94 towards the rod end 56 of the second hydraulic motor 24 and which allows flow through the second branch path 94 away from the rod end 56 of the second hydraulic motor 24, responsive to pressure in the head end 96 in the second hydraulic motor 24 exceeding a third pilot value. The pressure in the head end 96 of the second hydraulic motor 24 is communicated with the third pressure actuated check valve 114 via a third pilot line 116.

The third branch path 98 includes a fourth pressure actuated check valve 118 which always allows flow through the third branch path 98 toward the head end 96 of the second hydraulic motor 24 and which allows flow through the third branch path 98 away from the head end 96 of the second hydraulic motor 24, responsive to pressure in the rod end 56 of the second hydraulic motor 24 exceeding a fourth pilot value. Pressure in the rod end 56 of the second hydraulic motor 24 is communicated with the fourth pressure actuated check valve 118 via a fourth pilot line 120.

Operation

In practice, operation of the motor control lever 100, which shifts the motor control valve 88 via solenoid actuation of a pilot head and shifts the pilot control valve 82 via a mechanical linkage, can lead to a forward tipping when both the first hydraulic motor 22 and the second hydraulic motor 24 are expanding and a tipping rearwardly when both the first hydraulic motor 22 and the second hydraulic motor 24 are contracting. Operation of the pilot lever 84 can lead to a tilting leftwardly when the first hydraulic motor 22 contracts while the second hydraulic motor 24 expands and a tilting rightwardly when the first hydraulic motor 22 expands and the second hydraulic motor 24 contracts. Thus, tip forward, tip rearward, tilt left and tilt right positions are defined.

Turning first to the tip forward mode of operation, it is clear that in this mode of operation both the first hydraulic motor 22 and the second hydraulic motor 24 must be expanding. To accomplish this mode of operation, the pilot control valve 82 is shifted downwardly as urged by mechanical linkage represented by line 122 on motor control lever 100 whereby due to pilot pressure the main control valve 32 and the bypass control valve 32 are likewise shifted downwardly. This results in pressure being applied via the first flow path 38 and the first pressure actuated check valve 106 to the head end 40 of the first hydraulic motor 22. Simultaneously with the shift of the pilot control valve 82, the motor control valve 88 is shifted rightwardly by electrical means as represented by line 124 from the position illustrated in FIG. 2. As pressurized fluid enters the head end 40 of the first hydraulic motor 22, pressure from the rod end 50 thereof proceeds past the second pressure actuated check valve 110 which is open due to the signal from the second pilot line 112 then proceeds via the first branch path 92, the motor control valve 88, the fourth pressure actuated check valve 118 and the third branch path 98 to the head end 96 of the second hydraulic motor 24. Meanwhile, pressure from the rod end 56 of the second hydraulic motor 24 proceeds past the third pressure actuated check valve 114 which is actuated via the third pilot line 116 and thence via the second branch path 94 and the second flow path 42 to the sump 30. When sufficient pressure has built up to open the first bypass valve 46 due to the rod of the first hydraulic motor 22 having bottomed out, then pressure from the third flow path 48 which is equal to the total pressure of the main supply pump 28 is supplied to the rod end 50 of the first hydraulic motor 22 through which it flows and proceeds past the second pressure actuated check valve 110 which is actuated via the first pilot line 112 and thence via the first branch path 92, the motor control valve 88, past the fourth pressure actuated check valve 118 and via the third branch path 98 to the head end 96 of the second hydraulic motor 24.

Turning next to the tip rearward position, this is accomplished by simultaneous retraction of the first hydraulic motor 22 and the second hydraulic motor 24. Turning to FIG. 2 this corresponds to pressurized fluid being supplied to the rod end 50 of the first hydraulic motor 22 and at the same time hydraulic fluid being applied to the rod end 56 of the second hydraulic motor 24. To accomplish this, the pilot control valve 82 is shifted upwardly urged by mechanical linkage on lever 100 from the position illustrated in FIG. 2 whereby the main control valve 32 and the bypass control valve 62 are likewise shifted upwardly by the pilot pressure exerted by the pilot pump 76. Thereby, pressurized fluid from the main pump 28 is supplied to the conduit 42. Simultaneously with the shift of the control valve 82, the motor control valve 88 is shifted rightwardly through operator control thereof by use of the motor control lever 100. Flow then proceeds via the second flow path 42 to the second branch path 94 and thence to the rod end 56 of the second hydraulic motor 24. The flow leaves the head end 96 of the second hydraulic motor 24 and travels via the third branch path 98 and the motor control valve 88 to the first branch path 92, past the second pressure actuated check valve 110 and then to the rod end 50 of the first hydraulic motor 22. Pressure escapes from the head end 40 of the first hydraulic motor 22 past the first pressure actuated check valve 106 which is open due to the pressure which exists in the rod end 50 of the first motor 22 and through the main control valve 32 to the sump 30.

The bypass valve feature of the invention thus applies to tilt left, tilt right, and tilt forward operation; but not to tip back operation. The second bypass valve 52 will open as pressure builds in the conduit 72 but will direct oil to the same rod end 56 of the second motor 24 and therefore no flow path will be provided to tilt back the first motor 22 after the second motor 24 has fully retracted. Consequences are small because of the rod end to head end pumping ratios and, use of the bypass valve feature is basically unnecessary in the tip back mode.

Turning next to the tilt right mode of operation where the first hydraulic motor 22 is expanding while the second hydraulic motor 24 is contracting, it is clear that pressure must be applied to the head end 40 of the first hydraulic motor 22 and simultaneously to the rod end 56 of the second hydraulic motor 24. This can be accomplished by reference to FIG. 2 by shifting the pilot control valve 82 downwardly which through pilot pressure introduced into the conduit 80 leads to a downward shifting of the main control valve 32 and the bypass control valve 62. Meanwhile, the motor control valve 88 remains in its neutral leftward position just as shown in FIG. 2. In this situation, flow proceeds from the main pump 28 as directed via the first flow path 38 and past the first pressure actuated check valve 106 into the head end 40 of the first hydraulic motor 22. Flow from the rod end 50 of the first hydraulic motor 22 then proceeds past the second pressure actuated check valve 110 via the first branch path 92, then through the second branch path 94 and past the third pressure actuated check valve 114 and into the rod end 56 of the second hydraulic motor 24. Exhaust from the head end 96 of the second hydraulic motor 24 proceeds via the third branch path 98, the fourth pressure actuated check valve 118 which is actuated via the fourth pilot line 120, the motor control valve 88 and the second flow path 42 to the sump 30. When sufficient pressure, due to cylinder bottoming, has built up at the bias opposing portion 66 of the first bypass valve 46, full pressure from the main pump 28 proceeds via the third flow path 48 into the rod end 50 of the first hydraulic motor 22 and then passes through that rod end and on to the rod end 56 of the second hydraulic motor 24 with flow from the head end 96 of the second hydraulic motor 24 proceeding exactly as previously described.

Turning now to the tilt left mode of operation, it is clear that the first hydraulic motor 22 is contracting while the second hydraulic motor 24 is expanding. Turning to FIG. 2 this corresponds to pressurizing of the rod end 50 of the first hydraulic motor 22 and the head end 96 of the second hydraulic motor 24. To accomplish this, the pilot control valve 82 is moved upwardly in FIG. 2, which via the conduit 80 causes the main control valve 32 and the bypass control valve 62 to be moved likewise upwardly. Pressurized flow from the main pump 28 then proceeds via the second flow path 42 to the motor control valve 88 which is in the position shown in FIG. 2. The pressurized flow passes through the motor control valve 88 and thence proceeds past the fourth pressure actuated check valve 118 and along the third branch path 98 into the head end 96 of the second hydraulic motor 24. Fluid in the rod end 56 of the second hydraulic motor 24 then proceeds past the third pressure actuated check valve 114 via the second branch path 94, through the motor control valve 88, then through the first branch path 92 and the second pressure actuated check valve 110 and into the head end 50 of the first hydraulic motor 22. Pressure from the head end 40 of the first hydraulic motor 22 escapes therefrom by proceeding past the first pressure actuated check valve 106 which is actuated by pressure in the first pilot line 108 and then proceeds via the first flow path 38 to the sump 30. When sufficient pressure has been built up at the biasing opposing portion 68 of the second bypass valve 52, pressure begins to flow from the main pump 28 to the fourth flow path 54 and then follows the flow path proceeding from the rod end 56 of the second hydraulic motor 24.

FIG. 3 illustrates schematically the lever actuated tipping and tilting functions as well as illustrating a Float, Neutral and Raise position for the blade 10.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. In a fluid flow control system for an earth moving blade pivotally supported on a vehicle for selectively varying the tip and tilt of said blade relative to a ground surface through selectable extension and contraction of a first and a second hydraulic motor which communicate between said vehicle and said blade, an improvement comprising:

(1) main pump means;

(2) main control valve means receiving a main inflow from said main pump means and being in flow communication via a first flow path with a head end of said first hydraulic motor and in flow communication via a second flow path with said second hydraulic motor and delivering an outflow from said second hydraulic motor to sump means;

(3) a first bypass valve in a third flow path communicating said main control valve means with a rod end of said first hydraulic motor;

(4) a second bypass valve in a fourth flow path communicating said main control valve means with a rod end of said second hydraulic motor;

(5) first biasing means biasing said first bypass valve closed;

(6) second biasing means biasing said second bypass valve closed;

(7) bypass control valve means receiving said main inflow and delivering said main inflow selectively to a bias opposing portion of a respective one of said first and second bypass valves to cause said respective one of said first and second bypass valves to open responsive to pressure in a respective one of said first and second flow paths producing a force exceeding a force due to a respective one of said first and second biasing means while connecting with a bias opposing portion of a respective other of said first and second bypass valves and communicating said respective other bias opposing portion to said sump means;

(8) pilot pump means;

(9) pilot control valve means receiving a pilot inflow from said pilot pump means and selectively delivering said pilot inflow to substantially simultaneously shift said main control valve means and said bypass control valve means into a first pilot mode in which said bypass control valve means delivers said main inflow to said bias opposing portion of said first bypass valve while said main control valve means delivers said main inflow to said head end of said first hydraulic motor, and into a second pilot mode in which said bypass control valve means delivers said main inflow to said bias opposing portion of said second bypass valve while said main control valve means delivers said main inflow to said second hydraulic motor;

(10) operator shiftable control means for selectively shifting said pilot control valve means to said first and second pilot modes;

(11) motor control valve means in a hydraulic motor flow path communicating said rod end of said first hydraulic motor with said second hydraulic motor, said motor control valve means fluid flow connecting in a first motor mode said rod end of said first hydraulic motor with said rod end of said second hydraulic motor while simultaneously fluid flow connecting a head end of said second hydraulic motor to said sump means and in a second motor mode fluid flow connecting said rod end of said first hydraulic motor to said head end of said second hydraulic motor while simultaneously fluid flow connecting said rod end of said second hydraulic motor to said sump means; and

(12) operator shiftable motor control means for selectively shifting said motor control valve means to said first and second motor modes.

2. An improvement as in claim 1, wherein said motor control valve means comprises a solenoid control valve which controls application of pressure from said pilot pump means to shift said motor control valve means to said first motor mode and to said second motor mode and said operator shiftable motor control means comprises a solenoid actuator circuit having a power source and tip control lever means adjustable to selectively make and break said circuit.

3. An improvement as in claim 1, including a first branch path from said rod end of said first hydraulic motor to said motor control valve means, a second branch path from said motor control valve means to said rod end of said second hydraulic motor, a third branch path from said head end of said second hydraulic motor to said motor control valve means and a sump path from said motor control valve means to said sump means and wherein in said first motor mode said motor control valve means connects said first branch path to said second branch path and said third branch path to said sump path and in said second motor mode said motor control valve means connects said first branch path to said third branch path and said second branch path to said sump path.

4. An improvement as in claim 3, wherein said first flow path includes first pressure actuated check valve means which always allows flow therethrough towards said head end of said first hydraulic motor and which allows flow therethrough away from said head end of said first hydraulic motor responsive to pressure in said rod end of said first hydraulic motor exceeding a first pilot value, said first branch path includes second pressure actuated check valve means which always allows flow therethrough towards said rod end of said first hydraulic motor and which allows flow therethrough away from said rod end of said first hydraulic motor responsive to pressure in said head end of said first hydraulic motor exceeding a second pilot value, said second branch path includes third pressure actuated check valve means which allows flow therethrough towards said rod end of said second hydraulic motor and which allows flow therethrough away from said rod end of said second hydraulic motor responsive to pressure in said head end of said second hydraulic motor exceeding a third pilot value, and said third branch path includes fourth pressure actuated check valve means which always allows flow therethrough towards said head end of said second hydraulic motor and which allows flow therethrough away from said head end of said second hydraulic motor responsive to pressure in said rod end of said hydraulic motor exceeding a fourth pilot value.

5. In a fluid flow control system for an earth moving blade pivotally supported on a vehicle for selectively varying the tip and tilt of said blade relative to a ground surface through selectable extension and contraction of a first and a second hydraulic motor which communicate between said vehicle and said blade responsive to directing of fluid flow from main pump means by main control valve means receiving a main inflow from said main pump means and being in flow communication via a first flow path with a head end of said first hydraulic motor and in flow communication via a second flow path with said second hydraulic motor and delivering an outflow from said second hydraulic motor to sump means, an improvement comprising;

(1) a first biased closed bypass valve in a third flow path communicating said main control valve means with a rod end of said first hydraulic motor;

(2) a second biased closed bypass valve in a fourth flow path communicating said main control valve means with a rod end of said second hydraulic motor;

(3) bypass control valve means receiving said main inflow and delivering said main inflow selectively to a bias opposing portion of a respective one of said first and second bypass valves to produce a sufficient force to overcome the biasing thereof and thereby cause said respective one of said first and second bypass valves to open responsive to pressure in a respective one of said first and second flow paths while connecting with a bias opposing portion of a respective other of said first and second bypass valves and communicating said respective other bias opposing portion to said sump means;

(4) pilot control valve means receiving a pilot inflow and selectively delivering said pilot inflow to substantially simultaneously shift said main control valve means and said bypass control valve means into a first pilot mode in which said bypass control valve means delivers said main inflow to said bias opposing portion of said first bypass valve while said main control valve means delivers said main inflow to said head end of said first hydraulic motor, and into a second pilot mode in which said bypass control valve means delivers said main inflow to said bias opposing portion of said second bypass valve while said main control valve means delivers said main inflow to said second hydraulic motor; and (5) operator shiftable control means for selectively shifting said pilot control valve means to said first and second pilot modes.

6. An improvement as in claim 1, including:

motor control valve means in a hydraulic motor flow path communicating said rod end of said first hydraulic motor with said second hydraulic motor, said motor control valve means fluid flow connecting in a first motor mode said rod end of said first hydraulic motor with said rod end of said second hydraulic motor while simultaneously fluid flow connecting a head end of said second hydraulic motor to said sump means and in a second motor mode fluid flow connecting said rod end of said first hydraulic motor to said head end of said second hydraulic motor while simultaneously fluid flow connecting said rod end of said second hydraulic motor to said sump means; and operator shiftable motor control means for selectively shifting said motor control valve means to said first and second motor modes.

* * * * *